US010814189B1

(12) United States Patent
Myers

(10) Patent No.: US 10,814,189 B1
(45) **Date of Patent: *Oct. 27, 2020**

(54) GOLF CLUB HEAD WITH ADJUSTABLE HOSEL

(71) Applicant: Callaway Golf Company, Carlsbad, CA (US)

(72) Inventor: Matthew Myers, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/797,475

(22) Filed: Feb. 21, 2020

Related U.S. Application Data

(63) Continuation of application No. 16/514,060, filed on Jul. 17, 2019, now Pat. No. 10,596,421.

(51) Int. Cl.
*A63B 53/02* (2015.01)
*A63B 53/04* (2015.01)

(52) U.S. Cl.
CPC ..... *A63B 53/02* (2013.01); *A63B 53/023* (2020.08); *A63B 53/0466* (2013.01); *A63B 2209/00* (2013.01)

(58) Field of Classification Search
USPC ..... 473/324–350
See application file for complete search history.

(56) References Cited

U.S. PATENT DOCUMENTS 4,715,601 A * 12/1987 Lamanna ..... A63B 53/047 473/291
5,165,688 A * 11/1992 Schmidt ..... A63B 53/02 473/315
5,295,686 A * 3/1994 Lundberg ..... A63B 53/00 473/291
5,429,353 A * 7/1995 Hoeflich ..... A63B 53/047 473/350
5,653,645 A * 8/1997 Baumann ..... A63B 60/00 473/305
6,547,675 B2 * 4/2003 Sherwood ..... A63B 53/04 473/290

(Continued)

FOREIGN PATENT DOCUMENTS

JP 09271544 A * 10/1997
JP 2001231896 A * 8/2001

(Continued)

*Primary Examiner* — Alvin A Hunter
(74) *Attorney, Agent, or Firm* — Rebecca Hanovice; Michael Catania; Sonia Lari

(57) ABSTRACT

A golf club head having an adjustable hosel assembly and a plug assembly that can reversibly secure the hosel assembly in a chosen configuration within the club head is disclosed herein. In particular, the hosel assembly includes a shaft sleeve that is trapped within a hosel opening with a screw that extends through an interior flange. The plug assembly includes a wedge-shaped flange that is inserted into an opening in the body and fits between the interior flange and the head of the screw to temporarily immobilize the shaft sleeve. The plug assembly preferably completely fills the opening in the body so as to preserve a smooth outer mold line of the club head and allow graphics or decorations to extend across the exterior surface without disruption.

20 Claims, 6 Drawing Sheets

(56) References Cited

U.S. PATENT DOCUMENTS 6,638,178 B2 * 10/2003 Tseng ..... A63B 60/00 473/306
6,769,996 B2 * 8/2004 Tseng ..... A63B 53/02 473/306
7,147,572 B2 * 12/2006 Kohno ..... A63B 53/0466 473/314
7,413,518 B2 * 8/2008 Cole ..... A63B 53/02 473/288
7,513,835 B2 * 4/2009 Belmont ..... A63B 53/0466 473/328
7,874,934 B2 * 1/2011 Soracco ..... A63B 53/02 473/307
7,883,430 B2 * 2/2011 Thomas ..... A63B 60/00 473/307
7,931,543 B2 * 4/2011 Burrows ..... A63B 53/02 473/288
7,980,960 B2 * 7/2011 Gilbert ..... A63B 53/04 473/290
8,133,133 B2 * 3/2012 Gilbert ..... A63B 53/047 473/312
8,221,259 B2 * 7/2012 Thomas ..... A63B 53/02 473/307
8,235,834 B2 * 8/2012 De La Cruz ..... A63B 53/02 473/307
8,235,837 B2 * 8/2012 Bennett ..... A63B 53/047 473/307
8,388,464 B2 * 3/2013 Gilbert ..... A63B 53/04 473/332
8,535,172 B2 * 9/2013 O'Shea, III ..... A63B 53/02 473/305
8,684,861 B2 * 4/2014 Carlyle ..... A63B 53/047 473/331
8,715,104 B1 * 5/2014 Wall, Jr. ..... A63B 53/02 473/309
8,727,906 B1 * 5/2014 Aguinaldo ..... A63B 53/06 473/307
8,753,221 B1 * 6/2014 Aguinaldo ..... A63B 53/06 473/307
8,801,536 B2 * 8/2014 O'Shea, III ..... A63B 53/02 473/305
9,022,879 B2 * 5/2015 Sato ..... A63B 53/02 473/307
9,132,323 B2 * 9/2015 Beach ..... A63B 53/02
9,630,067 B2 * 4/2017 Kohno ..... A63B 53/02
9,724,572 B2 * 8/2017 Mizutani ..... A63B 53/04
10,010,768 B2 * 7/2018 Mizutani ..... A63B 53/0466
10,039,963 B2 * 8/2018 Ripp ..... A63B 53/02
10,238,930 B2 * 3/2019 Ripp ..... A63B 53/06
10,376,752 B2 * 8/2019 Higdon ..... A63B 53/02
10,561,909 B2 * 2/2020 Ripp ..... A63B 53/047
10,596,421 B1 * 3/2020 Myers ..... A63B 53/02

FOREIGN PATENT DOCUMENTS

JP 2003199850 A * 7/2003 ..... A63B 53/047
JP 2005185751 A * 7/2005

* cited by examiner

GOLF CLUB HEAD WITH ADJUSTABLE HOSEL

CROSS REFERENCES TO RELATED APPLICATIONS

The present application claims priority to, and is a continuation of, U.S. patent application Ser. No. 16/514,060, filed on Jul. 17, 2019, the disclosure of which is hereby incorporated by reference in its entirety herein.

STATEMENT REGARDING FEDERALLY SPONSORED RESEARCH OR DEVELOPMENT

Not Applicable

BACKGROUND OF THE INVENTION

Field of the Invention

The present invention relates to a golf club head with an adjustable hosel assembly that can be reversibly fixed in place by a plug assembly inserted through an opening in the heel side of the head.

Description of the Related Art

Various golf club manufacturers offer golf club heads with adjustable hosels. Most of these club heads include a sole opening, in communication with a hosel through-opening extending from the top of the hosel to the crown, through which a screw is inserted to engage the shaft sleeve. While this structure allows a user to reversibly attach the shaft sleeve, and thereby the shaft, to the club head, the sole opening occupies a great deal of space, minimizing the area where manufacturers can add weight to increase the draw bias of the head. Furthermore, dirt and debris can get caught in the sole opening, thereby damaging or negatively affecting the playability of the club. The structure of the hosel, which requires an internal structure to support the through-bore, also places an undesirable quantity of mass close to the face. Therefore, there is a need for a golf club head with an adjustable or removable shaft sleeve assembly and a closed sole profile, while removing mass from near the face.

BRIEF SUMMARY OF THE INVENTION

The present invention relates to a golf club head, and particularly club heads such as drivers, fairway-woods, and hybrids, comprising an adjustable hosel assembly and a plug assembly that reversibly fixes the hosel assembly in place at desired loft and lie configurations.

One aspect of the present invention is a golf club head comprising a club body comprising a face, a crown, a sole, a hosel, a heel side, a toe side, an interior cavity defined by the face, crown, and sole, a cutout region in the heel side of the sole, a threaded bore, and an internal flange extending from the heel side into the interior cavity, an adjustable hosel assembly comprising a shaft sleeve and a retention screw, and a plug assembly comprising a plug body and a body-engagement screw, wherein the hosel comprises a hosel opening and a hosel axis extending through a center point of the hosel opening, wherein the internal flange comprises a flange opening that is aligned with the hosel opening along the hosel axis, wherein the retention screw comprises a head portion and a threaded extension portion that extends through the flange opening to engage with a threaded tip end of the shaft sleeve, wherein the threaded bore is disposed proximate the cutout region, wherein the internal flange is disposed between the cutout region and the hosel, wherein the plug body comprises a U-shaped flange and a through-bore, wherein the plug body is sized to fit within the cutout region so that the through-bore aligns with the threaded bore, and the U-shaped flange engages with the threaded extension section within the interior cavity, wherein at least a portion of the body-engagement screw extends through the through-bore and into the threaded bore to reversibly affix the plug body to the body, and wherein when the plug body is affixed to the body, the U-shaped flange is disposed between the internal flange and the head of the retention screw and presses against the head of the retention screw to fix the shaft sleeve to the body.

In some embodiments, the club body may not comprise an internal hosel tube. In other embodiments, the U-shaped flange may have an approximately wedge-shaped cross-sectional shape. In other embodiments, the golf club head may further comprise a spherical washer encircling the threaded extension portion of the retention screw and disposed between the head portion and the flange. In any of these embodiments, the golf club head may further comprise a gasket disposed on an interior-facing surface of the plug body and at least partially encircling the through-bore. In a further embodiment, the gasket may be composed of a polymer material.

In other embodiments, when the plug body is fully engaged with the body, an exterior surface of the plug body may be flush with an exterior surface of the body. In a further embodiment, the exterior surface of the plug body may be decorated to blend in with a decorated exterior surface of the body. In any of the embodiments, each of the club body and the plug body may be composed of a titanium alloy. In some embodiments, the internal flange may extend at an angle with respect to the hosel axis that is greater than 90°. In any of the embodiments, at least one edge of the internal flange may be suspended within the interior cavity.

Another aspect of the present invention is a driver-type golf club head comprising a club body comprising an interior cavity defined by a face, a sole, and a crown, a hosel comprising a hosel opening and a hosel axis extending through a center point of the hosel opening, a cutout region, at least a portion of which is disposed in the sole and is aligned with the hosel axis, a sole ledge comprising a contact surface and a threaded ledge bore, the sole ledge disposed proximate the cutout region, and a flange extending into the interior cavity between the cutout region and the hosel, the flange comprising a flange opening aligned with the hosel axis, a hosel assembly comprising a shaft sleeve having a threaded tip portion, and a retention screw having a head portion and a threaded extension portion, and a plug assembly comprising a plug body having a U-shaped flange, an interior-facing surface, and an exterior surface, a connection plate having a through-hole, a gasket at least partially encircling the through-hole, and a body-engagement screw, wherein the threaded extension portion of the retention screw extends through the flange opening to engage with the threaded tip end of the shaft sleeve, wherein the connection plate extends from an edge of the plug body, wherein the plug body fits within the cutout region so that the U-shaped flange engages with the threaded extension section within the interior cavity, the gasket rests against the contact surface of the sole ledge, and the through-hole aligns with the threaded ledge bore, wherein at least a portion of the body-engagement screw extends through the through-hole and into the threaded bore to reversibly affix the plug body to the body, and wherein when the plug body is affixed to the body, the U-shaped flange is disposed between the internal flange and the head of the retention screw and presses against the head of the retention screw to fix the shaft sleeve to the body.

In some embodiments, the club body may not include an internal hosel tube. In other embodiments, the internal flange may extend at an angle of greater than 90° with respect to the hosel axis. In still other embodiments, the threaded ledge bore may be a through-bore in communication with the interior cavity. In another embodiment, the cutout region may be disposed below the internal flange and above the sole ledge with respect to the hosel. In still other embodiments, the hosel assembly may further comprise at least one adjustable ring encircling the shaft sleeve. In still other embodiments, each of the club body and plug body may be composed of a metal material, and the gasket may be composed of a polymer material. In an alternative embodiment, the face, the sole, and the hosel may be integrally cast from a metal material. In another embodiment, the through-hole may have an oval shape.

Having briefly described the present invention, the above and further objects, features and advantages thereof will be recognized by those skilled in the pertinent art from the following detailed description of the invention when taken in conjunction with the accompanying drawings.

BRIEF DESCRIPTION OF THE SEVERAL VIEWS OF THE DRAWINGS

FIG. 10 is an enlarged view of the circled portion of the embodiment shown in

FIG. 9.

DETAILED DESCRIPTION OF THE INVENTION

Figure 1:
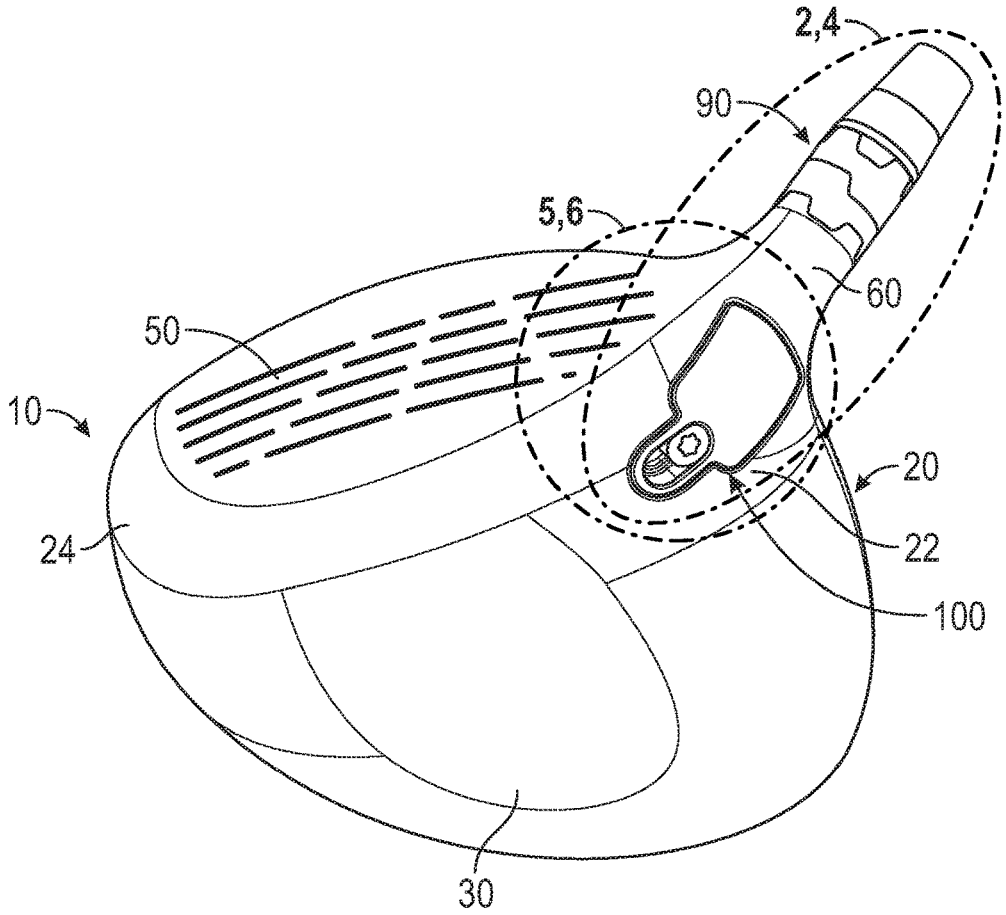
FIG. 1 is a sole perspective view of the golf club head of the present invention.
Figure 2:
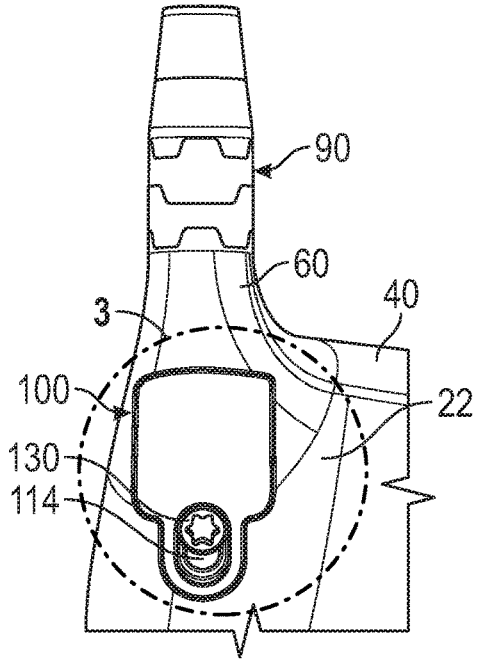
FIG. 2 is a side perspective view of the circled portion of the embodiment shown in FIG. 1.
Figure 3:
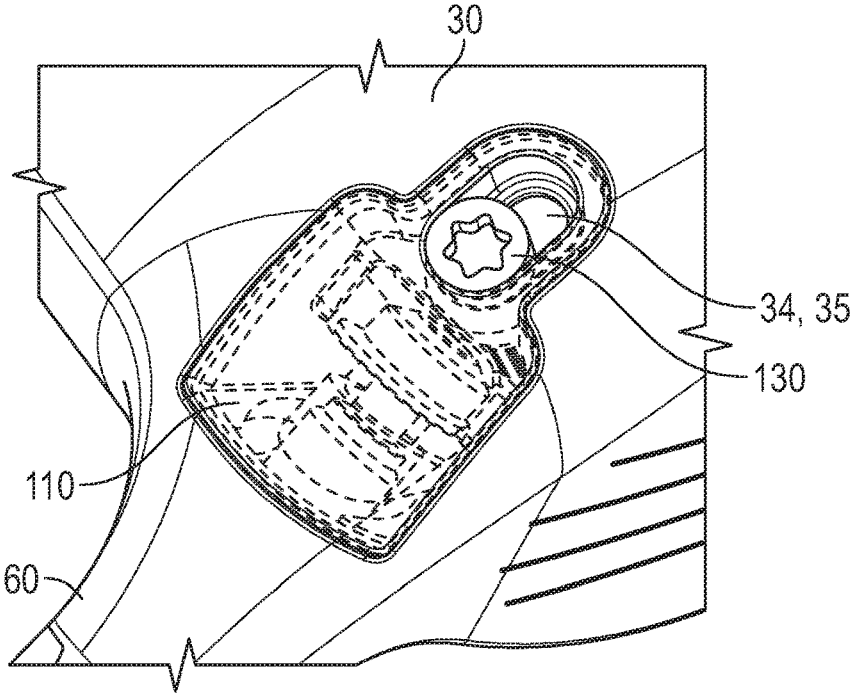
FIG. 3 is an enlarged, partially transparent view of the circled portion of the embodiment shown in FIG. 2.
Figure 4:
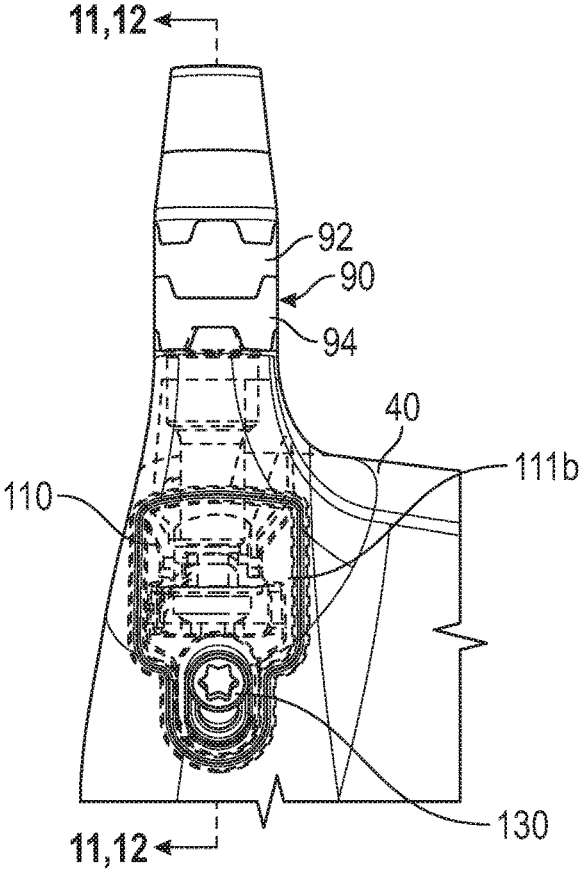
FIG. 4 is a partially transparent view of the embodiment shown in FIG. 2.
Figure 5:
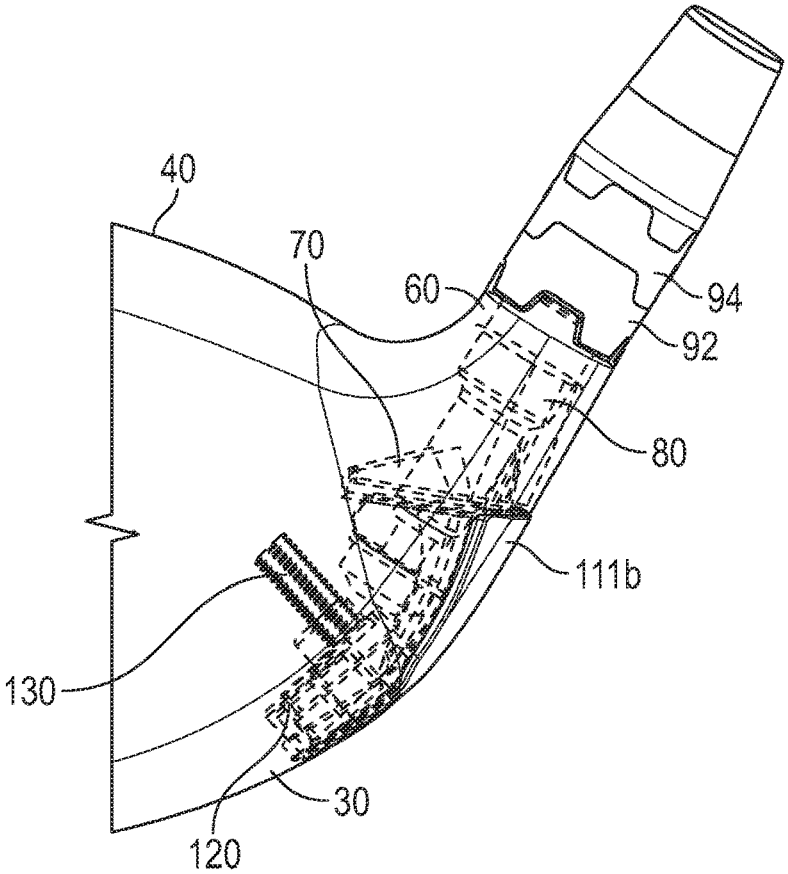
FIG. 5 is a partially transparent view of the circled portion of the embodiment shown in FIG. 1.
Figure 6:
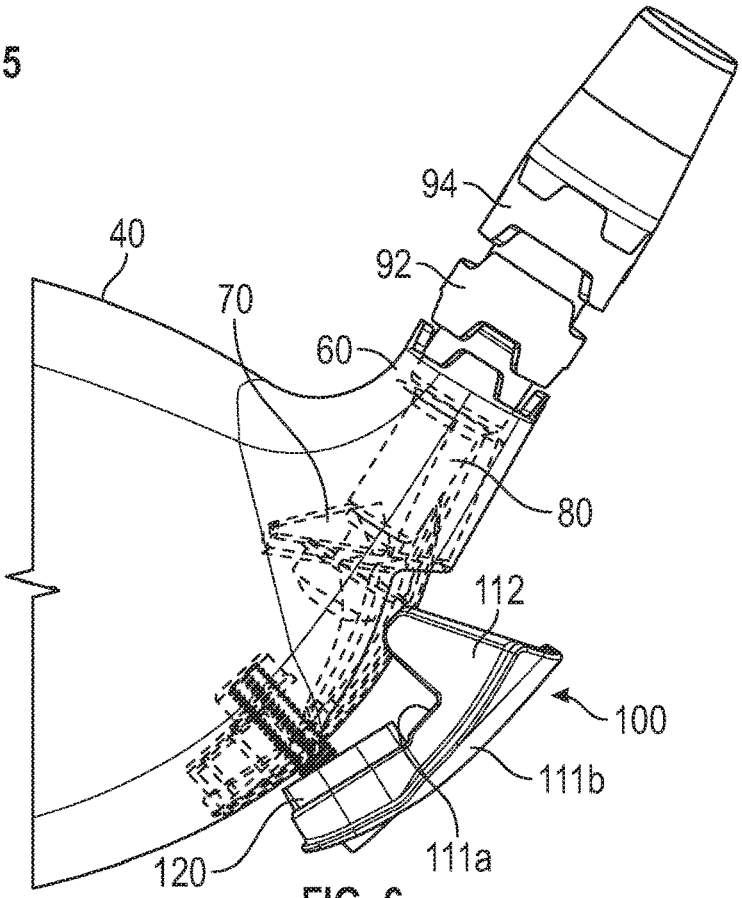
FIG. 6 is an exploded view of the embodiment shown in FIG. 5.
Figure 7:
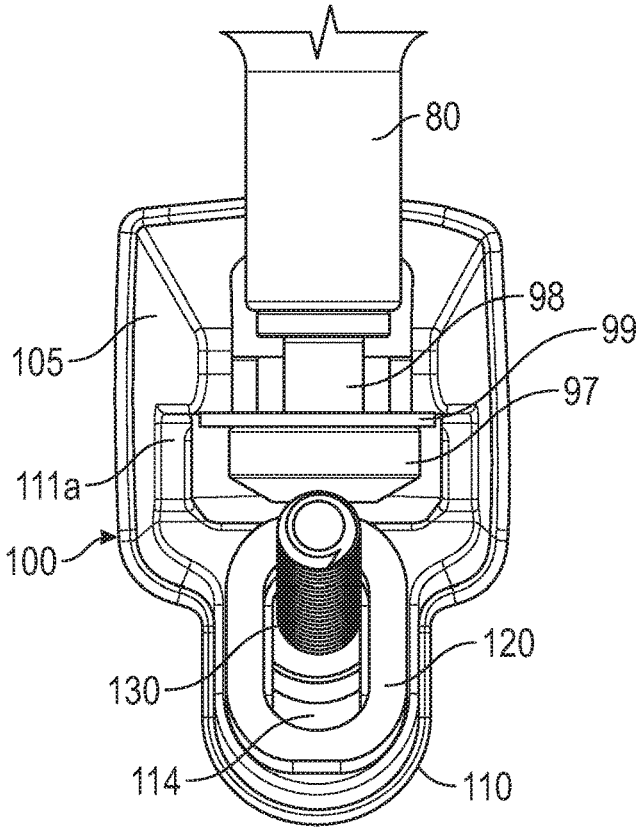
FIG. 7 is a front view of the plug assembly engaged with the hosel assembly.
Figure 8:
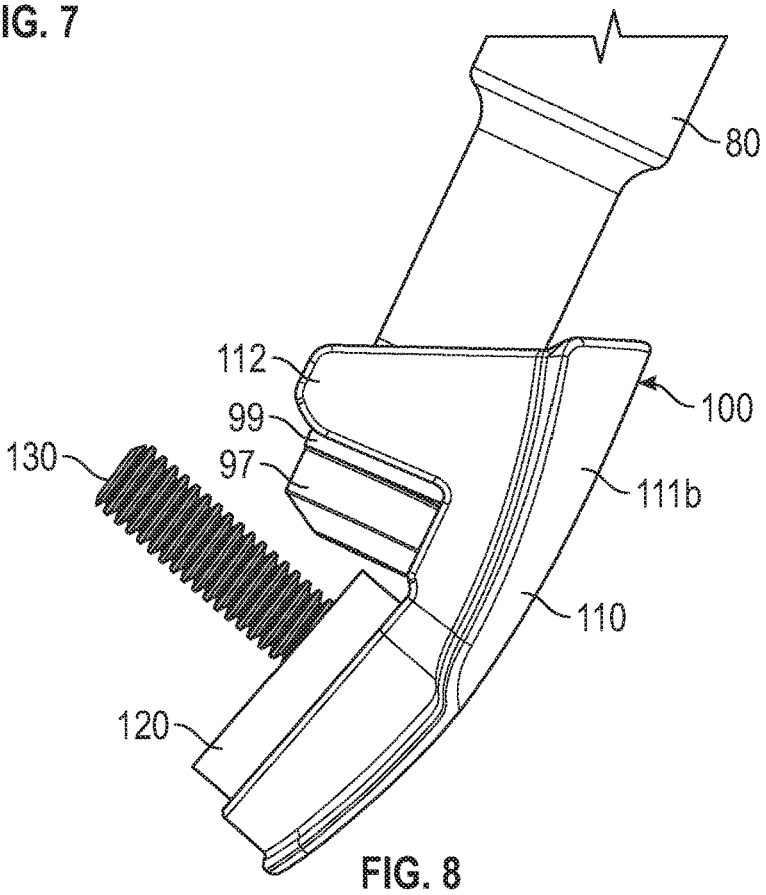
FIG. 8 is a side view of the embodiment shown in FIG. 7.
Figure 9:
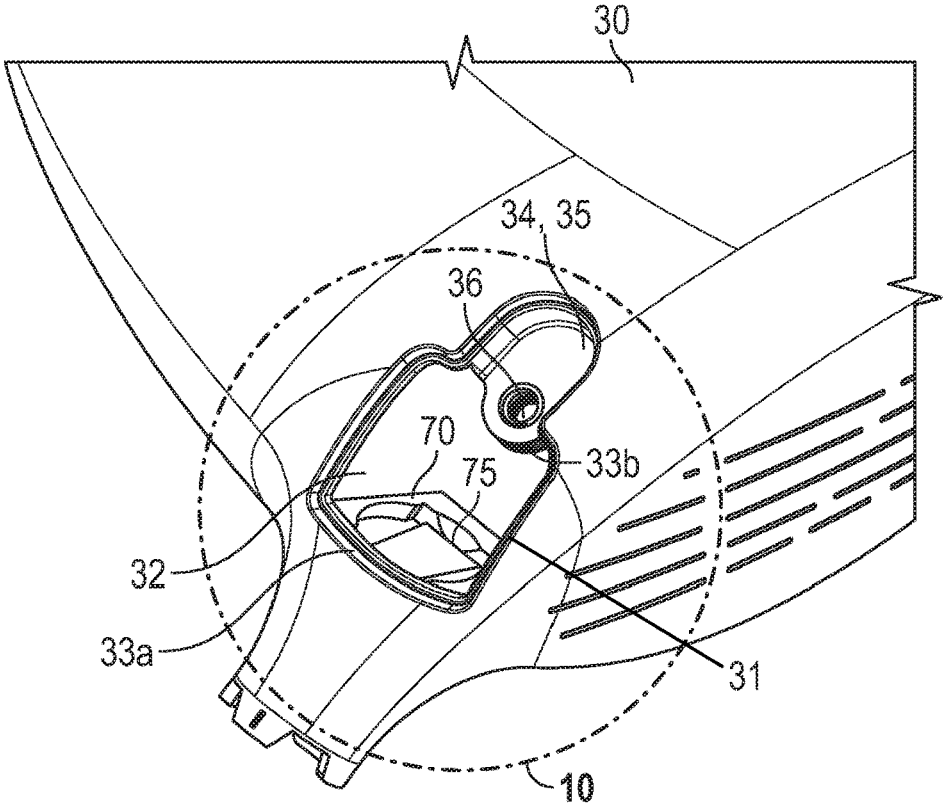
FIG. 9 is a sole perspective view of the golf club head shown in FIG. 1 without the hosel or plug assemblies.
Figure 10:
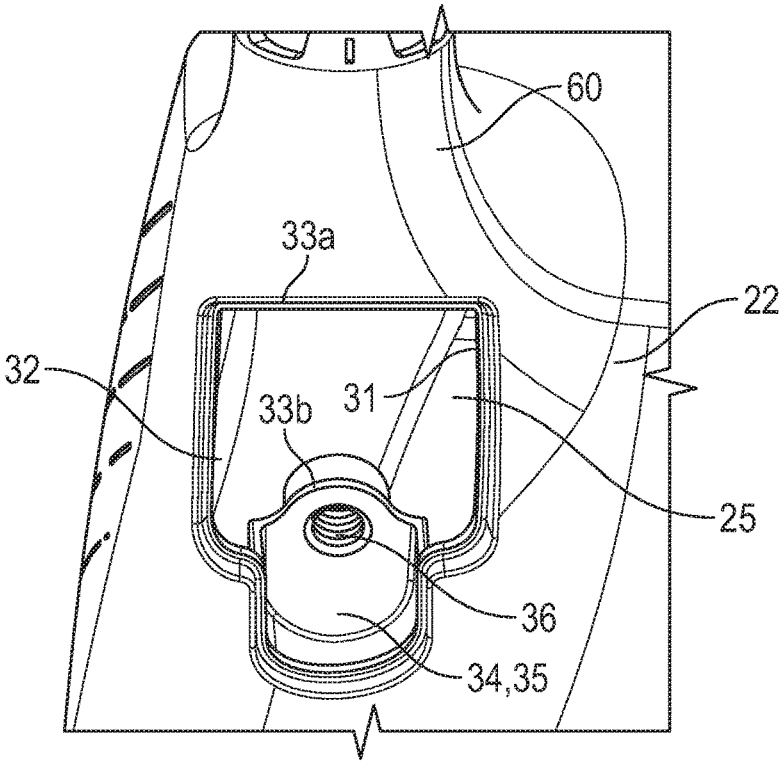

The present invention is directed to a golf club head 10 with an adjustable hosel assembly 90 and a plug assembly 100 that reversibly fixes the hosel assembly 90 in place and prevents the hosel assembly 90 from moving when the golf club head 10 is in use.

A preferred embodiment of the present invention is shown in FIGS. 1-12. The golf club head 10, which in this embodiment is a driver, comprises a body 20 with a heel side 22, a toe side 24, a sole 30, crown 40, face 50, and hosel 60. The sole 30, crown 40, and face 50 connect with one another to define a hollow interior cavity 25.

The body 20 lacks a traditional, internal hosel tube construction. Instead of a hosel tube, the hosel 60 has an opening 62 that is in direct communication with the interior cavity 25, with a hosel axis 64 extending through the center of the hosel opening 62. The body 20 comprises an internal flange 70, which includes a flange opening 75, extending into the interior cavity 25 from the heel side 22. The internal flange 70 is located below the hosel opening 62, and extends at an angle $\alpha$ with respect to the hosel axis 64 that is greater than 90°. Preferably, the internal flange 70 is cantilevered, attached to the heel side 22 of the body 20 so that at least one edge of the flange 70 is suspended within the interior cavity 25. Replacing a hosel tube with an internal flange 70 minimizes the mass of the structure proximate the face, thereby improving the overall flexibility of the face 50.

The sole 30 comprises a cutout region 32, which is generally aligned with the hosel axis 64 and extends into the heel side 22, and a ledge 34 disposed proximate, and preferably below (with respect to the hosel 60), the cutout region 32. The ledge 34 includes a contact surface 35 and a threaded ledge bore 36, which preferably is a through-bore that is communication with the interior cavity 25. An upper edge 33*a* of the cutout region 32 is proximate to the internal flange 70 extending into the interior cavity 25, while a lower edge 33*b* of the cutout region 32 abuts the ledge 34.

The hosel opening 62 is sized to receive a shaft sleeve 80, which is connected to the tip end of a shaft (not shown), and which has a sleeve bore 82 and a threaded tip end 84. The shaft sleeve 80 extends through a pair of adjustable rings 92, 94, and into the interior cavity 25 via the hosel opening 62. The shaft sleeve 80 and rings 92, 94 may have any of the features disclosed in U.S. Pat. No. 9,174,097, the disclosure of which is hereby incorporated by reference in its entirety herein. Once the shaft sleeve 80 is disposed within the interior cavity 25, a retention screw 96 having a head portion 97 and a threaded extension portion 98 is affixed to the shaft sleeve 80 by threading the extension portion 98 through the flange opening 75 and into the threaded tip end 84, forming an adjustable hosel assembly 90. This configuration effectively locks the shaft sleeve 80 to the internal flange 70 of the body 20. In an alternative embodiment, instead of a retention screw 96, the shaft sleeve 80 may include a locking piece with a stem and ledge assembly as shown in U.S. Pat. No. 9,101,806, the disclosure of which is hereby incorporated by reference in its entirety herein.

Figure 11:
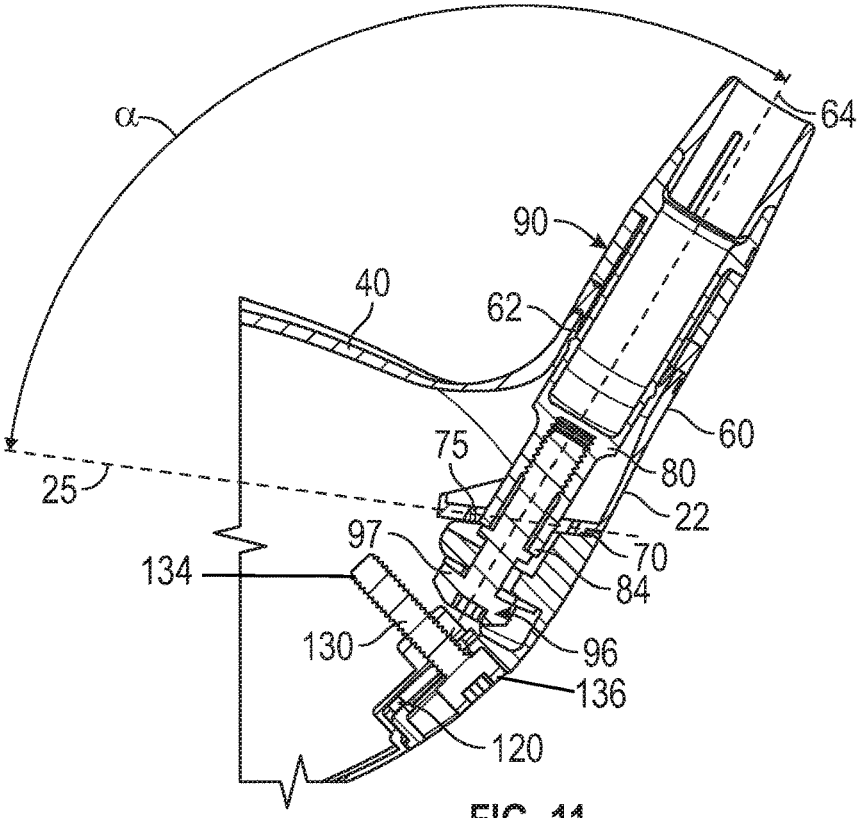
FIG. 11 is a cross-sectional view of the embodiment shown in FIG. 4 along lines 11-11.
Figure 12:
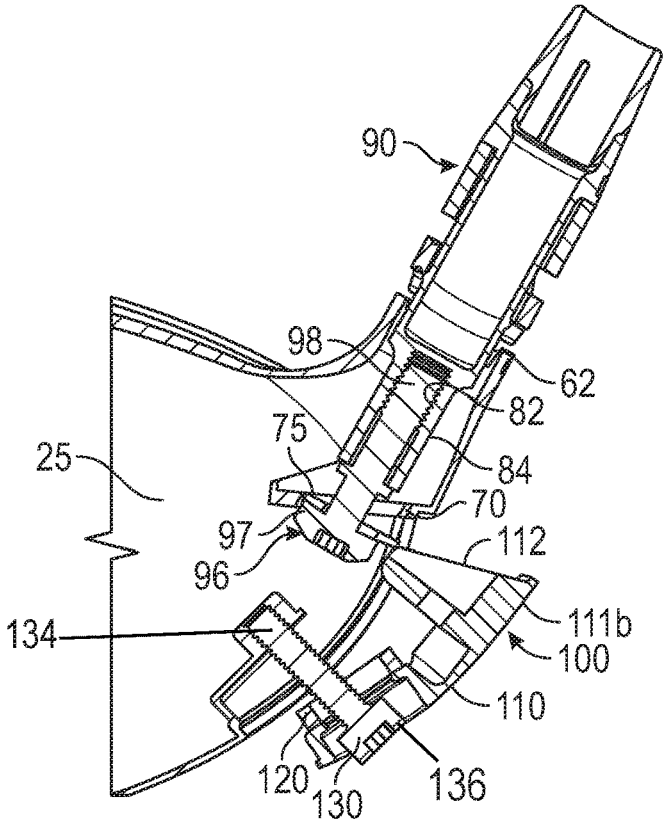
FIG. 12 is a cross-sectional, exploded view of the embodiment shown in FIG. 4 along lines 12-12.

When the shaft sleeve 80 is fixed to the hosel 60, the threaded tip end 84 of the shaft sleeve 80 extends through the flange opening 75 as shown in FIG. 11. When the shaft sleeve 80 is loosened from the hosel 60 to allow for adjustment of the rings 92, 94 of the hosel assembly 90, the threaded tip end 84 of the shaft sleeve 80 is disposed slightly above the internal flange 70 as shown in FIG. 12. In either configuration, the head portion 97 of the retention screw 96 is disposed below the internal flange 70, and a spherical washer 99 is preferably disposed around the threaded extension portion 98 between the internal flange 70 and the head portion 97. This structure prevents the shaft sleeve 80 from disengaging from the body 20, even during adjustment of the rings 92, 94.

The shaft sleeve 80 is reversibly fixed to or loosened from the body 20 using a plug assembly 100 comprising a plug body 110, a spring washer or gasket 120, and a body-engagement screw 130. The plug body 110 comprises an interior-facing surface 111*a*, a U-shaped flange 112 extending from the interior-facing surface 111*a* of the body, a connection plate 113 with elongated through-hole 114, and an exterior surface 111*b*. The plug body 110 is sized to fit within, and follow the contours of, the cutout region 32, with the connection plate sized to fit within and extend over the shallow ledge so that the elongated through-hole 114 is aligned with the threaded ledge bore 36.

The plug assembly 100 reversibly fixes the hosel assembly 90 to the body 20 by sliding the plug body 110 into the cutout region 32 so that the U-shaped flange 112 fits between the head portion 97 of the retention screw 96 and the internal flange 70, and so that the connection plate 113 is fully disposed on the ledge, such that the exterior surface 111*b* is flush with an exterior surface 21 of the body 20. The opening of the U-shaped flange 112 is large enough to receive the threaded extension portion 98 of the retention screw 96, but small enough to prevent the head portion 97 from slipping through. The U-shaped flange 112, which has an approximately wedge-shaped cross-section, acts as a wedge when engaged with the flange 70 and retention screw 96, pressing the head portion 97 downwards within the interior cavity 25 and away from the internal flange 70, and locking the hosel assembly 90 in place with respect to the hosel 60. The plug assembly 100 is then secured to the body 20 by threading the body-engagement screw 130 through the elongated through-hole 114 so that a threaded portion 134 engages the threads of the threaded ledge bore 36 and the head 136 of the engagement screw 130 abuts the connection plate 113. This configuration is illustrated in FIGS. 1-5 and 11.

Loosening or removing the body-engagement screw 130 from the body 20 permits a user to remove the plug body 110 from the cutout region 32, thereby releasing the head portion 97 of the retention screw 96 and allowing the hosel assembly 90 to be adjusted with respect to the body 20. The gasket 120, which may be replaced or supplemented with a spring washer, helps back the plug body 110 out of the cutout region 32 when the body-engagement screw 130 is loosened.

When the plug assembly 100 is fully engaged with the body 20, the exterior surface 111*b* is flush with the exterior surface of the body 20, creating a closed, smooth sole 30 and heel side 22 with aerodynamics that improve upon the pre-existing, open sole golf club head concepts. This closed configuration allows manufacturers to apply graphics anywhere on the sole 30. The exterior surface 111*b* may be painted or otherwise decorated so that, when engaged with the golf club head 10, the plug assembly 100 blends in with the sole 30. The plug body 110 does not have to completely fill the cutout region 32, and, when engaged with the golf club head 10, there is preferably a slight spacing between the sidewalls 105 of the plug assembly 100 and the wall 31 surrounding the cutout region 32 to allow for manufacturing tolerances and ease of use.

The plug assembly 100 of the present invention preferably comprises a metal material, such as titanium alloy, steel, or aluminum alloy, and is more preferably entirely composed of metal, though in alternative embodiments it may be composed of a polymer dosed with a dense metal such as tungsten to adjust the mass properties of the golf club head 10. The shaft sleeve 80 preferably is composed of a less dense material than the plug assembly 100, such as aluminum alloy. In alternative embodiments, the screws 96, 130 of the present invention may be replaced with bolts or other mechanical connectors known to a person skilled in the art.

One benefit of this invention is that the adjustable hosel assembly 90 cannot be easily disengaged from the body 20 of the golf club 10, so pieces of the hosel assembly 90, such as the retention screw 96, will not get lost. The novel invention also provides coverage for an area of the adjustable golf club head 10 that traditionally has an opening in the sole 30. Yet another benefit of the invention is the fact that the plug assembly 100 itself can be weighted to improve draw bias of the club head, as disclosed in U.S. Pat. No. 10,076,691, the disclosure of which is hereby incorporated by reference in its entirety herein.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

The invention claimed is:

1. A golf club head comprising:

a club body comprising a face, a crown, a sole, a hosel, a heel side, a toe side, an interior cavity defined by the face, crown, and sole, a cutout region in the heel side of the sole, a threaded bore, and an internal flange extending from the heel side into the interior cavity;

a hosel assembly comprising a shaft sleeve and a retention screw; and a plug assembly comprising a plug body and a body-engagement screw, wherein the hosel comprises a hosel opening and a hosel axis extending through a center point of the hosel opening, wherein the internal flange comprises a flange opening that is aligned with the hosel opening along the hosel axis, wherein the retention screw comprises a head portion and a threaded extension portion that extends through the flange opening to engage with a threaded tip end of the shaft sleeve, wherein the threaded bore is disposed proximate the cutout region, wherein the internal flange is disposed between the cutout region and the hosel, wherein the plug body comprises a plug flange and a through-bore, wherein the plug body is sized to fit within the cutout region so that the through-bore aligns with the threaded bore, and the plug flange engages with the threaded extension section within the interior cavity, wherein at least a portion of the body-engagement screw extends through the through-bore and into the threaded bore to reversibly affix the plug body to the body, and wherein when the plug body is affixed to the body, the plug flange is disposed between the internal flange and the head of the retention screw and presses against the head of the retention screw to fix the shaft sleeve to the body.

2. The golf club head of claim 1, wherein the club body does not comprise an internal hosel tube.

3. The golf club head of claim 1, wherein the plug flange has an approximately wedge-shaped cross-sectional shape.

4. The golf club head of claim 1, further comprising a spherical washer encircling the threaded extension portion of the retention screw and disposed between the head portion and the flange.

5. The golf club head of claim 1, further comprising a gasket disposed on an interior-facing surface of the plug body and at least partially encircling the through-bore.

6. The golf club head of claim 5, wherein the gasket is composed of a polymer material.

7. The golf club head of claim 1, wherein when the plug body is fully engaged with the body, an exterior surface of the plug body is flush with an exterior surface of the body.

8. The golf club head of claim 7, wherein the exterior surface of the plug body is decorated to blend in with a decorated exterior surface of the body.

9. The golf club head of claim 1, wherein each of the club body and the plug body is composed of a titanium alloy.

10. The golf club head of claim 1, wherein the internal flange extends at an angle with respect to the hosel axis that is greater than 90°.

11. The golf club head of claim 1, wherein at least one edge of the internal flange is suspended within the interior cavity.

12. A driver-type golf club head comprising:

a club body comprising:

an interior cavity defined by a face, a sole, and a crown, a hosel comprising a hosel opening and a hosel axis extending through a center point of the hosel opening, a cutout region, at least a portion of which is disposed in the sole and is aligned with the hosel axis, a sole ledge comprising a contact surface and a threaded ledge bore, the sole ledge disposed proximate the cutout region, and a flange extending into the interior cavity between the cutout region and the hosel, the flange comprising a flange opening aligned with the hosel axis;

a hosel assembly comprising:

a shaft sleeve having a threaded tip portion, and a retention screw having a head portion and a threaded extension portion; and a plug assembly comprising:

a plug body having a plug flange, an interior-facing surface, and an exterior surface, a connection plate having a through-hole, a gasket at least partially encircling the through-hole, and a body-engagement screw, wherein the threaded extension portion of the retention screw extends through the flange opening to engage with the threaded tip end of the shaft sleeve, wherein the connection plate extends from an edge of the plug body, wherein the plug body fits within the cutout region so that the plug flange engages with the threaded extension section within the interior cavity, the gasket rests against the contact surface of the sole ledge, and the through-hole aligns with the threaded ledge bore, wherein at least a portion of the body-engagement screw extends through the through-hole and into the threaded bore to reversibly affix the plug body to the body, and wherein when the plug body is affixed to the body, the plug flange is disposed between the internal flange and the head of the retention screw and presses against the head of the retention screw to fix the shaft sleeve to the body.

13. The driver-type golf club head of claim 12, wherein the club body does not include an internal hosel tube.

14. The driver-type golf club head of claim 12, wherein the internal flange extends at an angle of greater than 90° with respect to the hosel axis.

15. The driver-type golf club head of claim 12, wherein the threaded ledge bore is a through-bore in communication with the interior cavity.

16. The driver-type golf club head of claim 12, wherein the cutout region is disposed below the internal flange and above the sole ledge with respect to the hosel.

17. The driver-type golf club head of claim 12, wherein the hosel assembly further comprises at least one adjustable ring encircling the shaft sleeve.

18. The driver-type golf club head of claim 12, wherein each of the club body and plug body is composed of a metal material, and wherein the gasket is composed of a polymer material.

19. The driver-type golf club head of claim 12, wherein the face, the sole, and the hosel are integrally cast from a metal material.

20. The driver-type golf club head of claim 12, wherein the through hole has an oval shape.

* * * * *